US006398273B1

(12) United States Patent
Aichmann

(10) Patent No.: US 6,398,273 B1
(45) Date of Patent: Jun. 4, 2002

(54) TAG WITH LOCKABLE SHACKLE

(75) Inventor: Ortwin Aichmann, Hoerbranz (AT)

(73) Assignee: Stoba AG, Horn (CH)

( * ) Notice: Subject to any disclaimer, the term of this patent is extended or adjusted under 35 U.S.C. 154(b) by 0 days.

(21) Appl. No.: 09/367,594

(22) PCT Filed: Feb. 3, 1998

(86) PCT No.: PCT/CH98/00043

§ 371 (c)(1),
(2), (4) Date: Aug. 18, 1999

(87) PCT Pub. No.: WO98/37531

PCT Pub. Date: Aug. 27, 1998

(30) Foreign Application Priority Data

Feb. 18, 1997 (CH) ..... 372/97

(51) Int. Cl.[7] ..... B65D 27/30
(52) U.S. Cl. ..... 292/323; 292/319
(58) Field of Search ..... 292/307 A, 307 R, 292/319, 320, 323, 324; 70/20

(56) References Cited

U.S. PATENT DOCUMENTS

| | | | | | |
|---|---|---|---|---|---|
| 906,052 | A | * | 12/1908 | Murray | 292/320 |
| 1,132,970 | A | * | 3/1915 | Peyton | 292/307 R |
| 1,553,188 | A | * | 9/1925 | Sauton | 292/318 |
| 1,964,015 | A | * | 6/1934 | Wenk | 292/320 |
| 1,964,897 | A | * | 7/1934 | Wenk | 292/320 |
| 2,006,042 | A | * | 6/1935 | Dietze | 292/328 |
| 4,278,281 | A | * | 7/1981 | Moberg | 292/320 |
| 4,500,124 | A | * | 2/1985 | Swift | 292/318 |
| 4,733,893 | A | * | 3/1988 | Davis | 292/320 |
| 4,779,911 | A | | 10/1988 | Wu | |
| 4,836,590 | A | | 6/1989 | Swift | |
| 4,893,853 | A | * | 1/1990 | Guiler | 292/320 |
| 4,909,552 | A | * | 3/1990 | Weber | 292/320 |
| 5,154,497 | A | | 10/1992 | Smith | |

FOREIGN PATENT DOCUMENTS

GB 2098576 A 11/1982

* cited by examiner

*Primary Examiner*—Gary Estremsky
(74) *Attorney, Agent, or Firm*—Crowell & Moring LLP

(57) ABSTRACT

The invention relates to a tag (1) comprising a shackle (4) mounted directly adjoining a sliding part (3), whereby said shackle in its locked position forms a closed circle together with the face of the wall of the tag housing (2). A locking element (5) positioned inside the housing in its locked position preferably clicks into both the sliding part (3) and the end of the shackle (4), thereby locking same in said position. In the locked position, the locking element (5) is pushed against a retaining cam (11) arranged inside the housing. If during an attempt to open the tag the sliding part (3) or shackle (4) is pulled and a certain pull force is exceeded, the built-in breakage area (12; 15) in the housing tears, thus providing clear, unambiguously and irreversible evidence of the attempted manipulation. This type of tag is especially suited as safety lock or safety seal.

22 Claims, 2 Drawing Sheets

TAG WITH LOCKABLE SHACKLE

BACKGROUND AND SUMMARY OF THE INVENTION

The present invention relates to a tag comprising a shackle which projects on the face of a flat housing and is molded to a sliding part which is displaceable from an open into a locked position arranged in the housing, in the locked position, the housing closing the shackle opening.

Tags of this type are used, for example, as key tags, as price tags, brand name tags, address tags, etc. on pieces of clothing, suitcases, briefcases, bags, umbrellas, sports articles, cameras, shoes, etc., the housing, in each case, as the information carrier, being provided with marking information, identification information or the like, which is glued, printed, embossed or engraved on the surfaces of the housing.

Thus, for example, from Swiss Patent Document CH 650 349, a tag of this type is known which can be produced easily and inexpensively and is constructed of a few parts. The locking shackle of this tag is simultaneously constructed as a sliding part which can be displaced in the tag housing and has latching elements which can resiliently lock in corresponding recesses of the tag housing. The locking shackle itself can be bent out in the open position, for example, for receiving keys or the like. In the closed position, it forms a closed eye together with the face of the tag housing, in which eye, for example, the key remains in a securely held manner. The closing position can be released from the outside by pressure onto the latching element against the locking direction, for which an opening is provided in the tag housing which is correspondingly accessible from the outside.

For certain fields of application, after a one-time closing, it should not be possible to open these tags again without destroying them. A tag of the above-mentioned type is suitable only to a limited extent because it can be unlocked from the outside in its originally provided form. A simple covering of the unlocking cover is also no reliable protection against an attempt to open the tag which subsequently can hardly or at least not unambiguously be noticed.

It was an object of the present invention to provide a tag of the above-mentioned type which has a simple construction and a simple operability for a one-time closure which, after the closing operation, can no longer be opened without being destroyed, in which case an attempt to open can clearly be determined.

According to the invention, this object is achieved by means of a tag of the above-noted type, characterized in that a locking element is arranged in the housing, which locking element, in the open and in the locked position, being resiliently clickable into the sliding part, the locking element being stopped in the direction of the shackle on a retaining cam projecting from a housing wall, in the transition area from the housing wall to the holding cam at least one area of the housing wall being constructed as a desired breaking point. The solution according to the invention is distinguished particularly by the simple construction and easy operability, while the locking is reliable. After the tag has been locked once, it can no longer be opened without being destroyed. The further development of the tag according to the invention has the special advantage that also an attempt to open the tag is clearly and in an irreversible manner indicated by the broken-open desired breaking point. As a result, manipulations on the tag can be detected without its complete destruction.

PREFERRED EMBODIMENTS OF THE INVENTION

In this case, the construction is particularly advantageous in which the slide as well as the shackle in the locked condition are gripped by the locking element or clicked into it. The desired breaking point is preferably formed in a very simple manner by a reduction of the wall thickness in this area of the housing.

Preferably, a tag according to the invention is used as a safety lock or a safety seal.

Other objects, advantages and novel features of the present invention will become apparent from the following detailed description of the invention when considered in conjunction with the accompanying drawings.

DETAILED DESCRIPTION OF THE DRAWINGS

Figure 1:
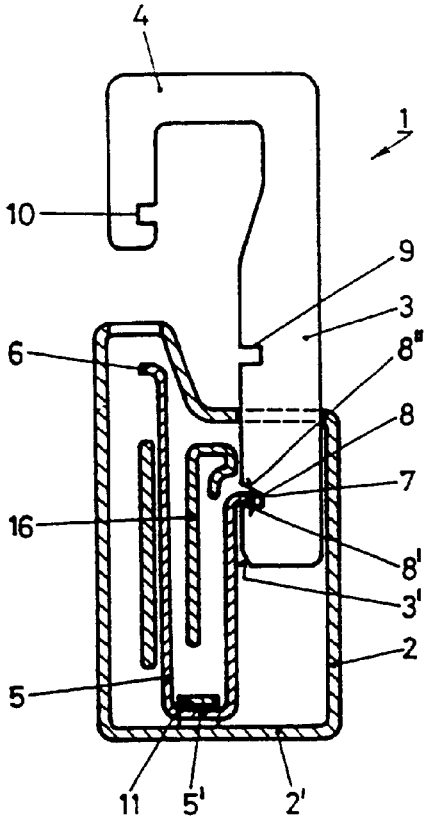
FIG. 1 is a schematic sectional view of a tag according to the invention in an open position.

A tag 1 according to the invention has a slide 3 which can be displaced in its housing 2. A shackle 4 is molded on directly at the upper end of the slide 3 and has a hook-shaped construction. In the illustrated open position, the shackle 4 forms an open ring with the face of the housing 2, by means of which ring the tag 1 can be hung into the part provided for this purpose.

In the housing 2, a locking element 5 is now arranged which is preferably constructed as an essentially U-shaped locking shackle. On its two legs, the locking element 5 has ends 6 and 7 which are each bent to the outside and which are used as locking latches. As a result of this construction of the locking element 5, the two legs can be resiliently moved toward the inside. In the position illustrated in FIG. 1, the locking latch 7 is locked into a recess 8 of the slide 3 and thereby fixes this slide 3 in the illustrated position. The recess 8 is preferably shaped out in such a trapezoidal shape that it has a lower stop surface 8' aligned perpendicularly to the leg of the locking element 5 and an upper stop surface 8" which extends diagonally thereto in the upward direction. As the result of this further development of the recess 8, the slide 3 cannot be pulled in the upward direction out of the housing 2 because it is blocked by the stop surface 8'. By applying pressure to the shackle 4, the slide can now be pressed into the housing 2 because, as a result of the diagonal stop surface 8", the leg of the locking element 5 is pressed toward the inside and can disengage from the recess 8.

It now also becomes clear that the slide 3 can simply be moved from the outside into the housing 2 into the position illustrated in FIG. 1. In that the slide 3, on its lower free end, also has a stop edge 3' constructed diagonally corresponding to the stop surface 8", when the slide 3 is slid into the housing 2, by means of this stop edge 3', the locking latch 7 is pressed toward the inside until it locks into the recess 8.

Figure 2:
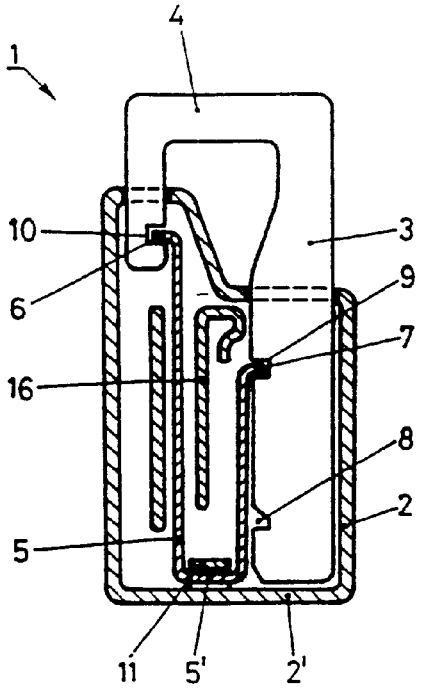
FIG. 2 is a sectional view according to FIG. 1 in the locked position.

FIG. 2 now shows the locked position of the tag 1. In this position, the locking latch 7 is clicked into the rectangular recess 9 of the slide 3. Thereby the slide 3 can no longer be displaced without swivelling the leg of the locking element 5 with the locking latch 7 out toward the inside. However, this is not possible because of the closed housing 2 without a destructive effect onto the tag 1 from the outside. In order to ensure an additional safety of the lock, preferably another recess 10 is provided in the shackle 4, in which relocking element 5 cess 10 the locking latch 6 of the second leg of the locks in the same manner. This also avoids that, by exercising force from the outside, only the shackle 4 is pulled out of the housing 2 or bent out, and therefore the closed ring formed by the shackle 4 and the face of the housing 2 can be opened.

As a result, a reliable tag 1 is formed which can be locked once, has a simple construction and can no longer be opened without being destroyed.

Figure 3:
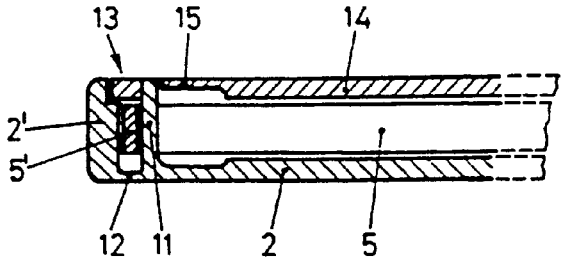
FIG. 3 is a longitudinal sectional view of the tag in the area of the retaining cam.
Figure 4:
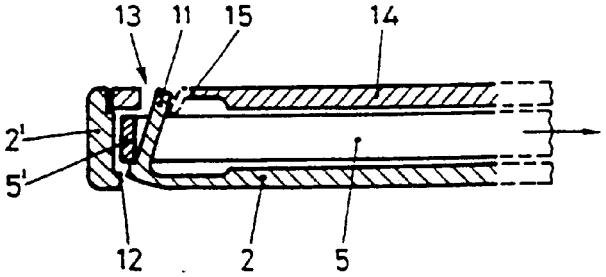
FIG. 4 is a longitudinal sectional view according to FIG. 3 during or after a manipulation.

According to the invention, the locking element 5 is arranged in the housing 2 such that its curved portion 5' is fixed between the lower housing wall 2' and a retaining cam 11, which is illustrated particularly clearly in the sectional view of FIG. 3. If a pull force is now exercised on the shackle 4 or the slide 3 with respect to the housing 2, this force is transmitted by way of the locking latches 6, 7 to the locking element 5 and thus directly by way of the curved portion 5'to the retaining cam 11. According to the invention, this retaining cam 11 is molded directly to the housing 2 and here directly to the bottom surface of the housing 2. In the transition area from the housing 2 to the retaining cam 11, according to the invention, a desired breaking point 12 is provided; in this case, preferably in the form of a very thin wall on one side of the retaining cam 11. If a pull force is now exercised on the shackle 4 or the slide 3 in the direction of the arrow, as illustrated in FIG. 4, this desired breaking point 12 tears when the correspondingly dimensioned or desired force value is exceeded, because of the bending of the retaining cam 11, as illustrated. This tear now remains permanently in the surface of the housing 2 and can be easily and rapidly recognized from the outside. As a result, an attempt to open the tag 1 can be recognized in a reliable and simple manner. Advantageously, this characteristic, specifically the tearing of the desired breaking point, can no longer be extinguished or covered up.

Preferably, a desired breaking point is provided not only on one side of the housing 2 but, for example, also on the front side, as also illustrated in FIG. 3. Here, for example, the retaining cam 11 projects into an opening 13 of a cover plate 14 forming the upper housing surface. This cover plate 14 is fixedly connected, for example, glued or welded to the housing 2 in the edge area. An area of the cover plate 14 around this opening 13 also has a desired breaking point 15, in that there retaining cam 11 is bent out because of a pull force acting upon the shackle 4 or the slide 3, as illustrated in FIG. 4, this causes a breaking of the corresponding desired breaking point 15. This can be easily recognized from the outside and cannot be reversed.

Figure 5:
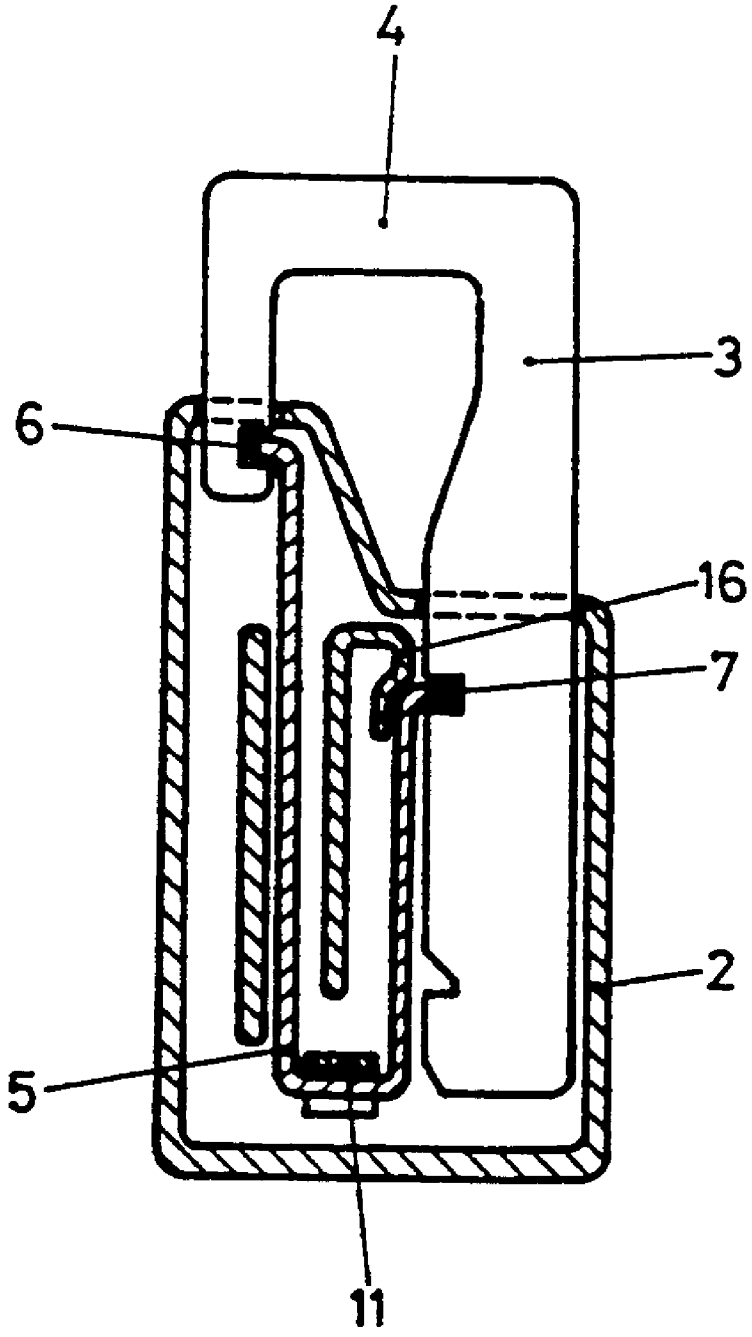
FIG. 5 is a sectional view according to FIG. 2 after an attempt to open has taken place.

Should an attempt to open nevertheless have been made, which has caused the desired breaking points 12, 15 to tear, a blocking web 16 is preferably arranged inside the housing 2 as an additional locking protection. This blocking web 16 preferably has the form of the end of the corresponding leg of the locking element 5 with the locking cam 7. Thus, a lateral bending-out of the locking element 5 is made impossible in this position, as illustrated in FIG. 5, Although the retaining cam 11 is very bent as the result of the tensile force and the corresponding desired breaking points 12 and 15 have torn, the locking cams 6 and 7 are still clicked into the corresponding recesses 9 and 10, which is why the slider 3 and thus also the shackle 4 can no longer be pulled out of the housing 2 and therefore remain locked, Even a destructive manipulation taking place from the outside can therefore no longer result in a clicking-out of the locking cam 6 or 7. A clicking-out of the locking cam 6 is caused here, for example, by the corresponding shape of the outer wall of the housing which prevents a lateral swivelling of the corresponding leg of the locking element 5. Even if, in this case, the retaining cam 11 were completely separated from its wall of the housing 2, a reliable locking of the slide 3 and the shackle 4 would thereby be ensured.

For these reasons, the tag according to the invention introduced here can be used particularly well as a safety lock or safety seal which is locked only once and cannot be opened up again without being destroyed. The advantage is that it can easily and unambiguously be checked whether or not any manipulation has taken place in an attempt to open the tag.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Tag comprising:

a housing, a shackle molded to a sliding part which is displaceably movable in said housing between a shackle open position and a shackle locked position with respect to said housing, a retaining cam connected with a wall of the housing, and a locking element disposed in the housing and held in place by walls of the housing and said retaining cam, said locking element being resiliently engageable with the sliding part to hold the sliding part in respective open and locked positions, wherein at least one area of said wall which is connected with the retaining cam is constructed with a desired breaking point such that unauthorized opening movements of said locking element and retaining cam from a shackle locked position can be visually detected at such breaking point even when such unauthorized opening movements do not result in movement of the locking element to a fully open position whereby opening attempts not resulting in opening of the shackle can be detected, and wherein the locking element is configured to be clicked into a free end of the shackle in the locked position.

2. Tag according to claim 1, wherein the locking element is configured such that when engaged with the sliding part to hold the sliding part in the open position, it can be clicked out of said open position only in a direction of the locked position when a locking force is applied.

3. Tag according to claim 1, wherein the locking element is constructed as a U-shaped member and has outwardly bent click-in elements on its two free legs.

4. Tag according to claim 3, wherein the desired breaking point is constructed as a wall area directly adjoining the retaining cam which is reduced with respect to the remaining wall thickness of the housing.

5. Tag according to claim 4, wherein the retaining cam is molded directly to a wall of the housing and projects into a corresponding recess of an opposite wall side.

6. Tag according to claim 5, wherein another desired breaking point in the form of a reduced wall thickness is arranged adjoining the recess.

7. Tag according to claim 3, wherein at least one blocking web is arranged in the housing adjoining the locking element, which blocking web prevents a bending-out of the locking element or an unlocking of this locking element in the locked condition if the locking element has been displaced within the housing in the direction of the shackle.

8. Tag comprising:

a housing, a shackle molded to a sliding part which is displaceably movable in said housing between a shackle open position and a shackle locked position with respect to said housing, a retaining cam connected with a wall of the housing, and a locking element disposed in the housing and held in place by walls of the housing and said retaining cam, said locking element being resiliently engageable with the sliding part to hold the sliding part in respective open and locked positions, wherein at least one area of said wall which is connected with the retaining cam is constructed with a desired breaking point such that unauthorized opening movements of said locking element and retaining cam from a shackle locked position can be visually detected at such breaking point even when such unauthorized opening movements do not result in movement of the locking element to a fully open position whereby opening attempts not resulting in opening of the shackle can be detected, and wherein the locking element is constructed as a U-shaped member and has outwardly bent click-in elements on its two free legs.

9. Tag according to claim 8, wherein the locking element is configured such that when engaged with the sliding part to hold the sliding part in the open position, it can be clicked out of said open position only in a direction of the locked position when a locking force is applied.

10. Tag comprising:

a housing, a shackle molded to a sliding part which is displaceably movable in said housing between a shackle open position and a shackle locked position with respect to said housing, a retaining cam connected with a wall of the housing, and a locking element disposed in the housing and held in place by walls of the housing and said retaining cam, said locking element being resiliently engageable with the sliding part to hold the sliding part in respective open and locked positions, wherein at least one area of said wall which is connected with the retaining cam is constructed with a desired breaking point such that unauthorized opening movements of said locking element and retaining cam from a shackle locked position can be visually detected at such breaking point even when such unauthorized opening movements do not result in movement of the locking element to a fully open position whereby opening attempts not resulting in opening of the shackle can be detected, wherein the desired breaking point is constructed as a wall area directly adjoining the retaining cam which is reduced with respect to the remaining wall thickness of the housing, and wherein the retaining cam is molded directly to a wall of the housing and projects into a corresponding recess of an opposite wall side.

11. Tag according to claim 10, wherein another desired breaking point in the form of a reduced wall thickness is arranged adjoining the recess.

12. Tag according to claim 11, wherein at least one blocking web is arranged in the housing adjoining the locking element, which blocking web prevents a bending-out of the locking element or an unlocking of this locking element in the locked condition if the locking element has been displaced within the housing in the direction of the shackle.

13. Tag according to claim 10, wherein at least one blocking web is arranged in the housing adjoining the locking element, which blocking web prevents a bending-out of the locking element or an unlocking of this locking element in the locked condition if the locking element has been displaced within the housing in the direction of the shackle.

14. Tag comprising:

a housing, a shackle molded to a sliding part which is displaceably movable in said housing between a shackle open position and a shackle locked position with respect to said housing, a retaining cam connected with a wall of the housing, and a locking element disposed in the housing and held in place by walls of the housing and said retaining cam, said locking element being resiliently engageable with the sliding part to hold the sliding part in respective open and locked positions, wherein at least one area of said wall which is connected with the retaining cam is constructed with a desired breaking point such that unauthorized opening movements of said locking element and retaining cam from a shackle locked position can be visually detected at such breaking point even when such unauthorized opening movements do not result in movement of the locking element to a fully open position whereby opening attempts not resulting in opening of the shackle can be detected, wherein the locking element is configured such that when clicked in the open position, it can be clicked out only in the direction of the locked position when a locking force is applied, wherein the desired breaking point is constructed as a wall area directly adjoining the retaining cam which is reduced several times with respect to the remaining wall thickness of the housing, and wherein the retaining cam is molded directly to a wall of the housing and projects into a corresponding recess of an opposite wall side.

15. Tag according to claim 14, wherein another desired breaking point in the form of a reduced wall thickness is arranged adjoining the recess.

16. Tag comprising:

a housing, a shackle molded to a sliding part which is displaceably movable in said housing between a shackle open position and a shackle locked position with respect to said housing, a retaining cam connected with a wall of the housing, and a locking element disposed in the housing and held in place by walls of the housing and said retaining cam, said locking element being resiliently engageable with the sliding part to hold the sliding part in respective open and locked positions, wherein at least one area of said wall which is connected with the retaining cam is constructed with a desired breaking point such that unauthorized opening movements of said locking element and retaining cam from a shackle locked position can be visually detected at such breaking point even when such unauthorized opening movements do not result in movement of the locking element to a fully open position whereby opening attempts not resulting in opening of the shackle can be detected, and wherein at least one blocking web is arranged in the housing adjoining the locking element, which blocking web prevents a bending-out of the locking element or an unlocking of this locking element in the locked condition if the locking element has been displaced within the housing in the direction of the shackle.

17. Tag comprising:

a housing, a shackle molded to a sliding part which is displaceably movable in said housing between a shackle open position and a shackle locked position with respect to said housing, a retaining cam connected with a wall of the housing, and a locking element disposed in the housing and held in place by walls of the housing and said retaining cam, said locking element being resiliently engageable with the sliding part to hold the sliding part in respective open and locked positions, wherein at least one area of said wall which is connected with the retaining cam is constructed with a desired breaking point such that unauthorized opening movements of said locking element and retaining cam from a shackle locked position can be visually detected at such breaking point even when such unauthorized opening movements do not result in movement of the locking element to a fully open position whereby opening attempts not resulting in opening of the shackle can be detected, wherein the desired breaking point is constructed as a wall area directly adjoining the retaining cam which is reduced with respect to the remaining wall thickness of the housing, and wherein at least one blocking web is arranged in the housing adjoining the locking element, which blocking web prevents a bending-out of the locking element or an unlocking of this locking element in the locked condition if the locking element has been displaced within the housing in the direction of the shackle.

18. Tag comprising:

a housing, a shackle molded to a sliding part which is displaceably movable in said housing between a shackle open position and a shackle locked position with respect to said housing, a locking element disposed in the housing and resiliently engageable with the sliding part to hold the sliding part in respective open and locked positions, and a retaining cam connected with a wall of the housing, said locking element being connected with the retaining cam, wherein at least one area of said wall which is movable with the retaining cam is constructed with a desired breaking point such that unauthorized opening movements of said locking element and retaining cam from a shackle locked position can be visually detected at such breaking point, wherein the locking element is configured to be clicked into a free end of the shackle in the locked position, and wherein the locking element is constructed as a U-shaped member and has outwardly bent click-in elements on its two free legs.

19. Tag comprising:

a housing, a shackle molded to a sliding part which is displaceably movable in said housing between a shackle open position and a shackle locked position with respect to said housing, a locking element disposed in the housing and resiliently engageable with the sliding part to hold the sliding part in respective open and locked positions, and a retaining cam connected with a wall of the housing, said locking element being connected with the retaining cam, wherein at least one area of said wall which is movable with the retaining cam is constructed with a desired breaking point such that unauthorized opening movements of said locking element and retaining cam from a shackle locked position can be visually detected at such breaking point, wherein the desired breaking point is constructed as a wall area directly adjoining the retaining cam which is reduced with respect to the remaining wall thickness of the housing, and wherein the retaining cam is molded directly to a wall of the housing and projects into a corresponding recess of an opposite wall side.

20. Tag according to claim 19, wherein another desired breaking point in the form of a reduced wall thickness is arranged adjoining the recess.

21. Tag according to claim 20, wherein at least one blocking web is arranged in the housing adjoining the locking element, which blocking web prevents a bending-out of the locking element or an unlocking of this locking element in the locked condition if the locking element has been displaced within the housing in the direction of the shackle.

22. Tag according to claim 19, wherein at least one blocking web is arranged in the housing adjoining the locking element, which blocking web prevents a bending-out of the locking element or an unlocking of this locking element in the locked condition if the locking element has been displaced within the housing in the direction of the shackle.

* * * * *